US005366098A

United States Patent [19]

Henry

[11] Patent Number: 5,366,098

[45] Date of Patent: Nov. 22, 1994

[54] HANGER FOR ARCHERY BOWS

[76] Inventor: Charles A. Henry, 4554 Malden Road, Windsor, Ontario, Canada, N9E 3T1

[21] Appl. No.: 139,146

[22] Filed: Oct. 21, 1993

[51] Int. Cl.[5] ..... A47F 7/00

[52] U.S. Cl. ..... 211/4; 211/105.1

[58] Field of Search ..... 211/105.1, 13, 113, 211/87, 4; 248/309.1, 552, 214, 215, 225.1, 251

[56] References Cited

U.S. PATENT DOCUMENTS

| | | | |
|---|---|---|---|
| 1,073,477 | 9/1913 | Dietz | 248/225.1 X |
| 2,459,909 | 1/1949 | Alofs | 248/214 |
| 2,938,695 | 5/1960 | Ciampa | 248/214 |
| 3,907,118 | 9/1975 | Pelavin | 211/113 |
| 4,036,463 | 7/1977 | Hopkins et al. | 248/309.1 |
| 4,901,871 | 2/1990 | Ohm etal. | 211/105.1 X |

*Primary Examiner*—Ramon O. Ramirez
*Assistant Examiner*—Sarah L. Purol
*Attorney, Agent, or Firm*—R. Craig Armstrong

[57] ABSTRACT

An archery bow hanger is capable of holding a bow or bows vertically and in parallel spaced relation to a door or wall on which the hanger is mounted. A mounting means may take the form of a U-shaped hook member which extends around the top edge of a door. The hook member is sufficiently thin that, when the door is closed, the hook member is able to sit between the door and its adjacent frame. The hook member is connected to one end of an extension member that extends away from the door, and a horizontal bar is connected to the other end of the extension member. A bow is held on the horizontal bar such that its respective limb and string extend on opposite sides of the bar. Several alternate mounting means are described. The hanger allows a bow to be vertically mounted such that the limb of the bow is directed away from the door or wall on which the hanger is mounted, adjustments to the bow being thereby facilitated.

8 Claims, 4 Drawing Sheets

HANGER FOR ARCHERY BOWS

This invention relates to archery, and more particularly, to a hanger for archery bows.

Until the advent of firearms, the archery bow was one of the major weapons of warfare. In modern times archery has become a sport enjoyed by millions, taking the form of either target shooting or 'bowhunting' of animals. Bows generally take one of two forms, The simpler bow is constructed with a string extending between the two outer ends of a curved wooden or metallic 'limb'. The compound bow is more complex, having a string that extends around a pulley on each outer end of the limb, and also around one or more additional pairs of pulleys before being anchored to the limb; this type of bow allows a user to exert a greater 'pull', for propelling a heavier arrow a greater distance than is possible with a simple bow. Although compound bows are a relatively recent development, statistics show that 86% of bowhunters own an average of two compound bows with over 60 pounds' pull.

The limb of a modern compound bow has a relatively complex shape, with a number of adjustment points. It is helpful in adjusting such a limb if it is mounted at body height to face the user, The hanger of the subject invention is intended to be fitted to a vertical surface to hold a series of bows such that the bow limbs are oriented outwardly, facilitating their adjustment. A further advantage of supporting the bow limbs such that they face away from the vertical surface is that the limbs are displayed to their best advantage.

Other types of bow hangers are known to the prior art. For instance, U.S. Pat. No. 4,628,893 discloses a bow hanger formed by a pair of plates fitted to a bow limb by fasteners and with a hook extending from the limb. This type of bow hanger, mounted on the limb during bow use, allows the bow to be mounted by the hook on a support member such that the bow faces that member. Although this type of bow hanger allows a bow to be quickly suspended when not in use, the hanger does not display the bow to its best advantage. It also does not provide an unobstructed front view of the limb compatible with facilitating limb adjustments. Two other types of bow hangers are shown in U.S. Pat. Nos. 4,722,501 and No. 4,889,307; however, neither operates in a similar way to the hanger of the subject invention.

The invention is an archery bow hanger that in one form can be easily installed on the door of a house, apartment or hotel. After being fitted to a door, it does not interfere with the closing of the door nor damage the door. It allows a bow to be conveniently held while adjustments are made, for instance, to the arrow rest, sights, nocks, kisser and peepsight of the bow, thus providing an alternative to holding a bow either in an expensive bow vise or between a person's knees while making adjustments. For the storage of bows, the hanger provides an alternate location to room corners and similar places in which expensive bows may suffer inadvertent damage.

The hanger comprises an attachment portion, an extension portion secured to the attachment portion, and a bow support bar secured to the extension portion. The attachment portion is adapted to be fitted to a vertical surface of a building at a sufficient height that when one end of an archery bow is supported on the hanger the other end of the bow is positioned above the floor. When the attachment portion is fitted to the vertical surface of the building the extension portion extends away from that surface and the bow support bar extends in generally parallel spaced relation with that surface. With the hanger fitted to the vertical surface of the building, a bow may be supported on the bow support bar such that the bar extends between the upper limb and the string on the one end of the bow. The limb of the bow is oriented to face away from the vertical surface.

The attachment portion may be a generally U-shaped bracket having a pair of parallel side members and a cross member integrally connected to the side members. In such case, the side members and cross member have a configuration and a thickness sufficiently thin to allow the bracket to be fitted around the top part of a closed door. Alternatively, the attachment portion may also include a block adapted to be secured by fasteners to the vertical surface. In such case, the side members and the cross member of the bracket have a configuration that allows the bracket to be fitted around the top part of the block. As a further alternative, the attachment portion may be a plate adapted to be fastened to the vertical surface of the building.

The hanger may further include a bolt adapted to extend through the support bar, and a U-shaped member having an aperture on each of its ends and a separation between those ends equal to the length of the support bar. The bolt is adapted to extend through both the support bar and the apertures on the ends of the U-shaped member when each of those ends is abutting a respective end of the support bar. In such secured position the U-shaped member prevents a bow being removed from the support bar. The hanger further includes a locking means adapted to fit onto the bolt to prevent withdrawal of the bolt when the U-shaped member is in the secured position.

The invention will next be more fully described by means of several preferred embodiments, utilizing the accompanying drawings, in which.

Figure 1:
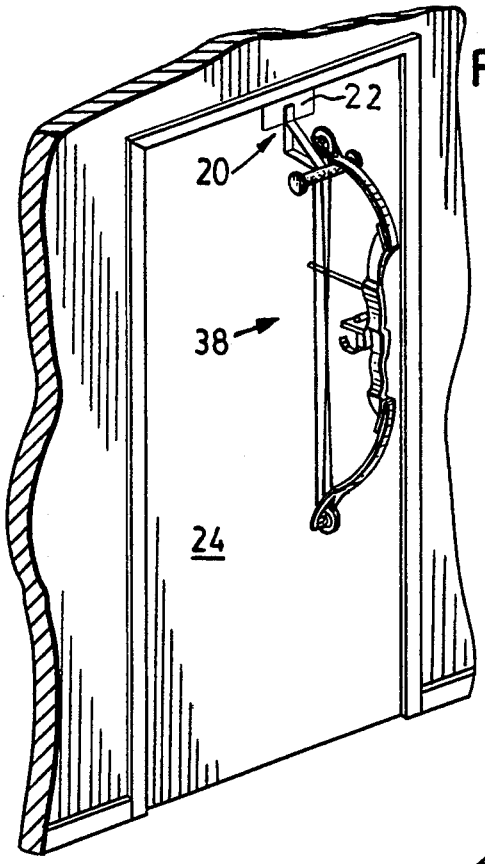
FIG. 1 is a perspective view of a first embodiment of the bow hanger of the subject invention, the hanger being shown fitted around the top of a closed door and supporting a compound bow.
Figure 3:
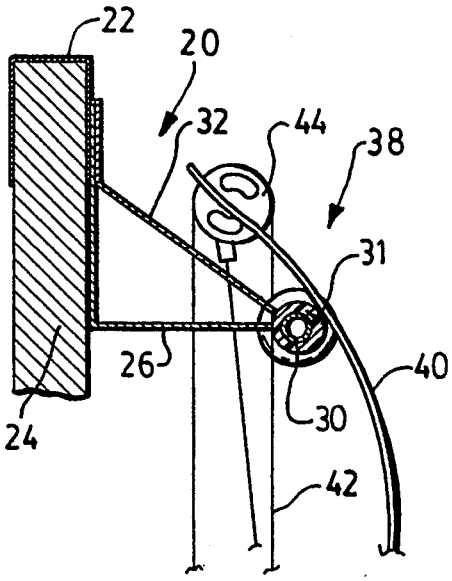
FIG. 3 is a partially-sectioned side view of the bow hangers of FIG. 1, the hanger supporting a compound bow.
Figure 2:
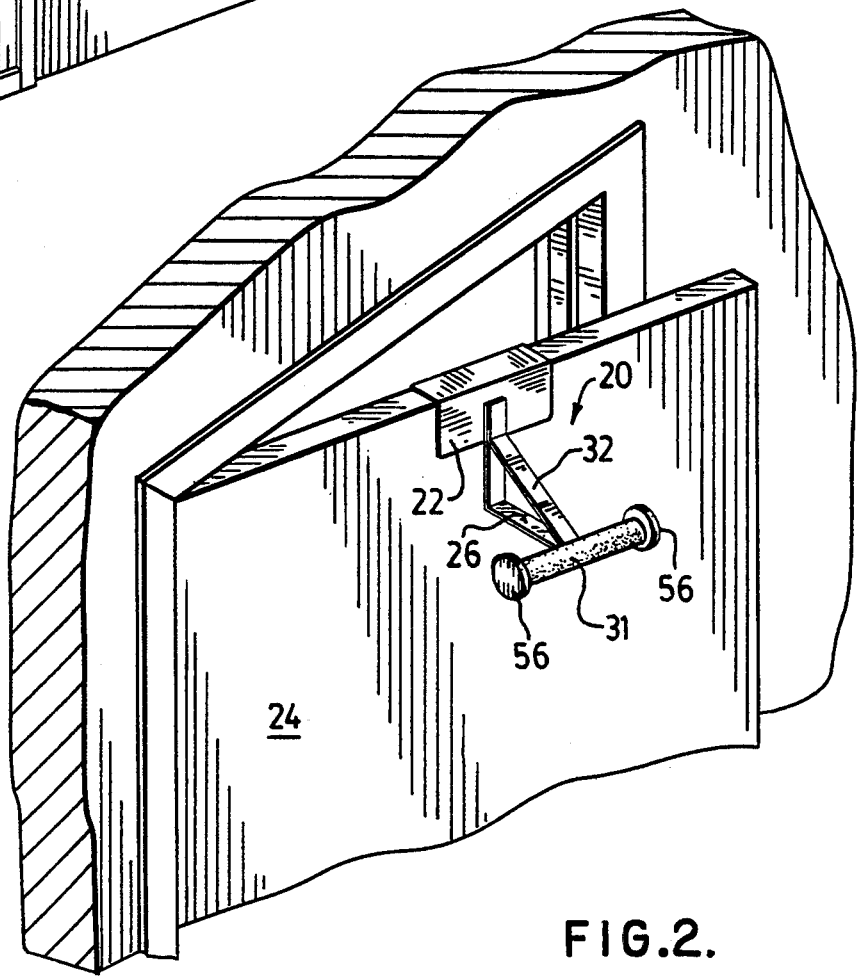
FIG. 2 is a perspective view similar to FIG. 1, but showing the door in the open position and without the bow on the hanger.

With respect to FIGS. 1, 2 and 3, a first embodiment of the bow hanger is generally designated 20. Bow hanger 20 has a hook member 22 formed from a folded plate of thin steel. As shown, the plate is folded such that its profile corresponds to that on the top section of a door 24. It is also possible to construct the plate with greater depth so that it can be fitted to doors of various thicknesses; in such case rubber spacers would be placed between the inside of door 24 and the adjacent side of hook member 22. Hook member 22 is sufficiently thin that the door 24 is closable with hook member 22 in position. A L-shaped first bracket piece 26 has a first end welded to a central position on one of the side members of hook member 22. A second end of first bracket piece 26 is welded to a central position on a pipe section 30 approximately 7.5 inches in length and with a 0.5-inch inside diameter. Pipe section 30 is covered by a foam cushion 31 having a thickness of approximately 0.3 inches. A second bracket piece 32 has a first end welded to the first end of first bracket piece 26, and a second end welded to pipe section 30 proximate the point where the second end of bracket piece 26 is welded.

Figure 6:
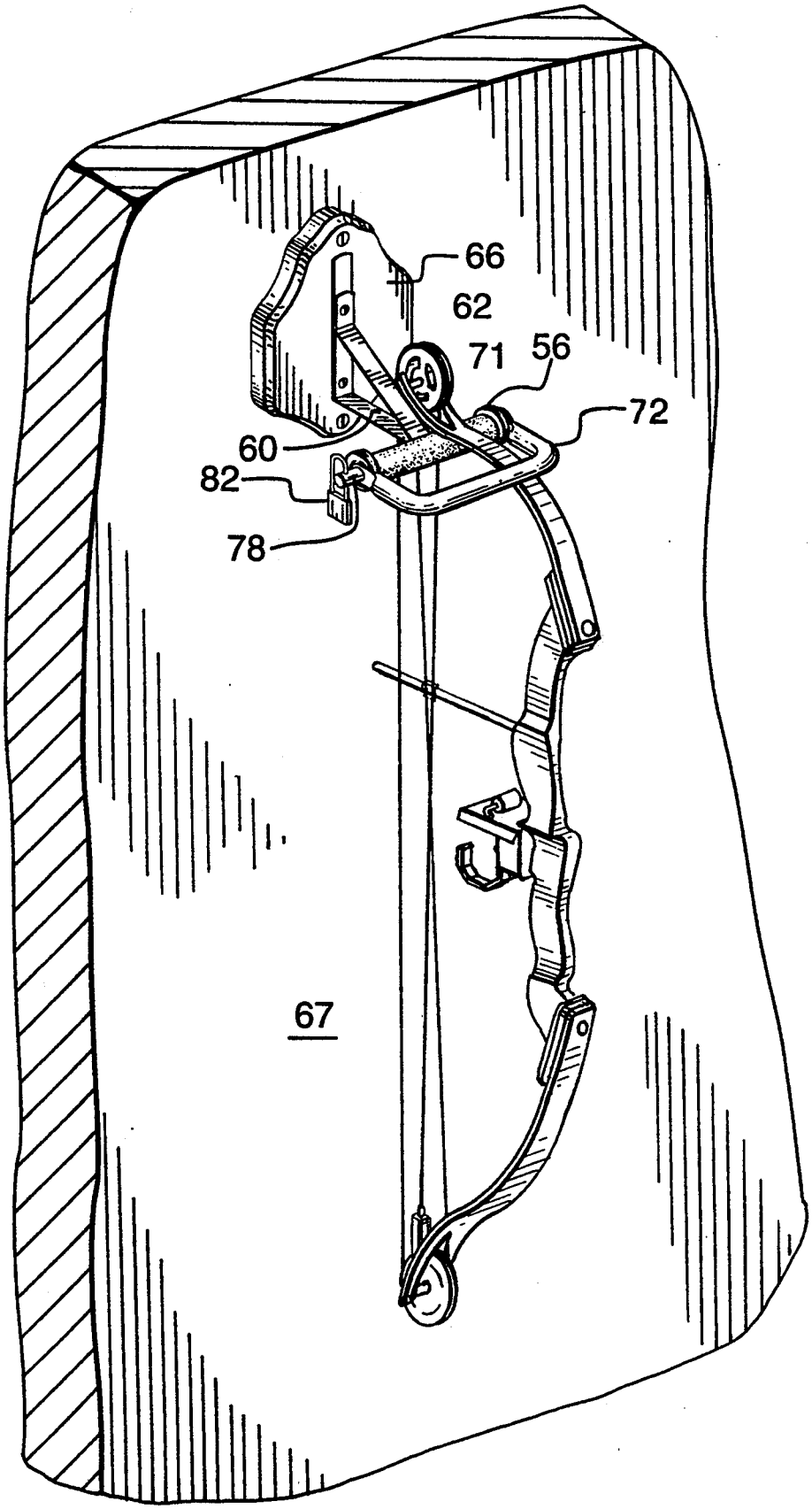
FIG. 6 is a perspective view of a second embodiment of the bow hanger of the subject invention, a plate on the hanger being secured by fasteners to the vertical surface.
Figure 7:
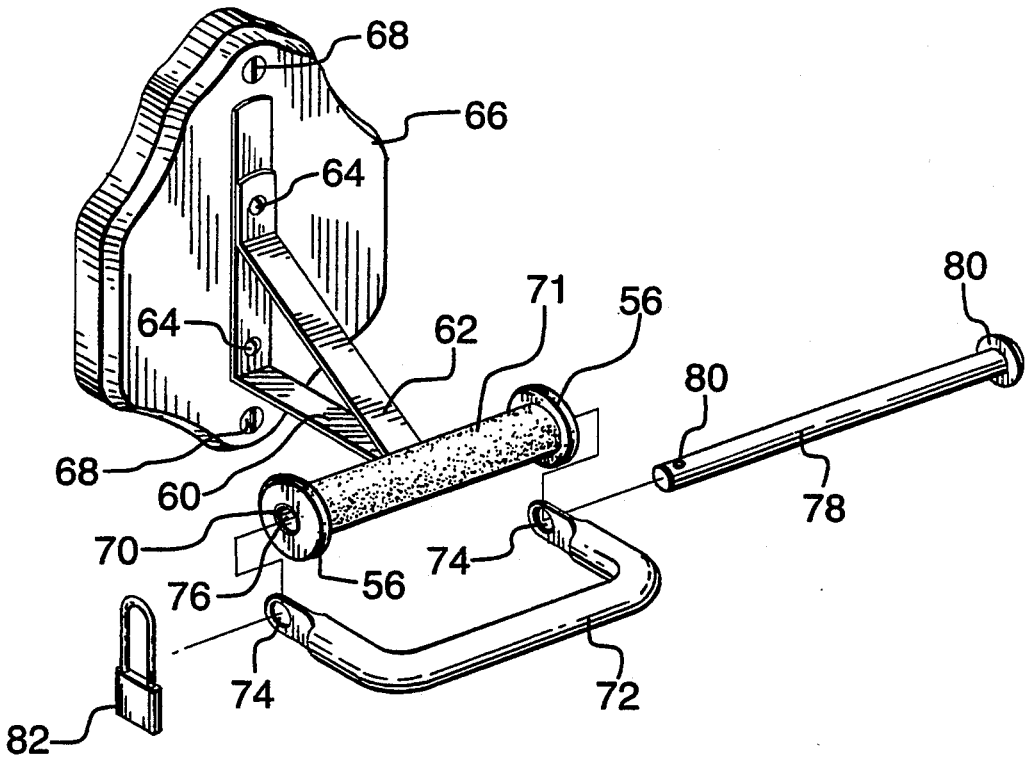
FIG. 7 is a perspective view of the hanger of FIG. 6, the vertical surface not being shown.
Figure 8:
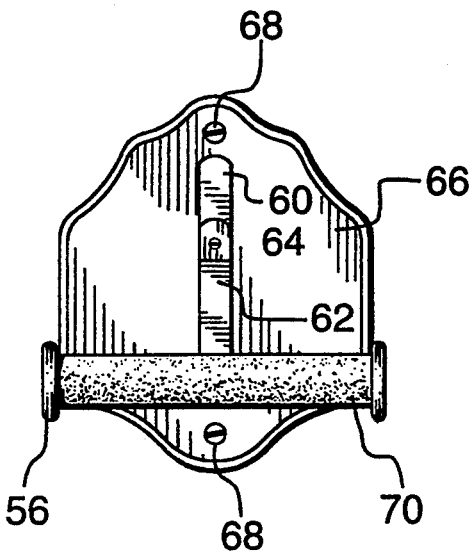
FIG. 8 is a front view of one part of the hanger of FIG. 6, the U-shaped member and bolt not being shown.

A compound bow generally designated 38 is supported on pipe section 30 such that the limb 40 of bow 38 extends on one side of pipe section 30 and one section of bowstring 42 extends on the other side. The bowstring 42 extends around a pulley 44 rotatably mounted on each end of limb 40, as better shown in FIGS. 1 and 6.

Figure 4:
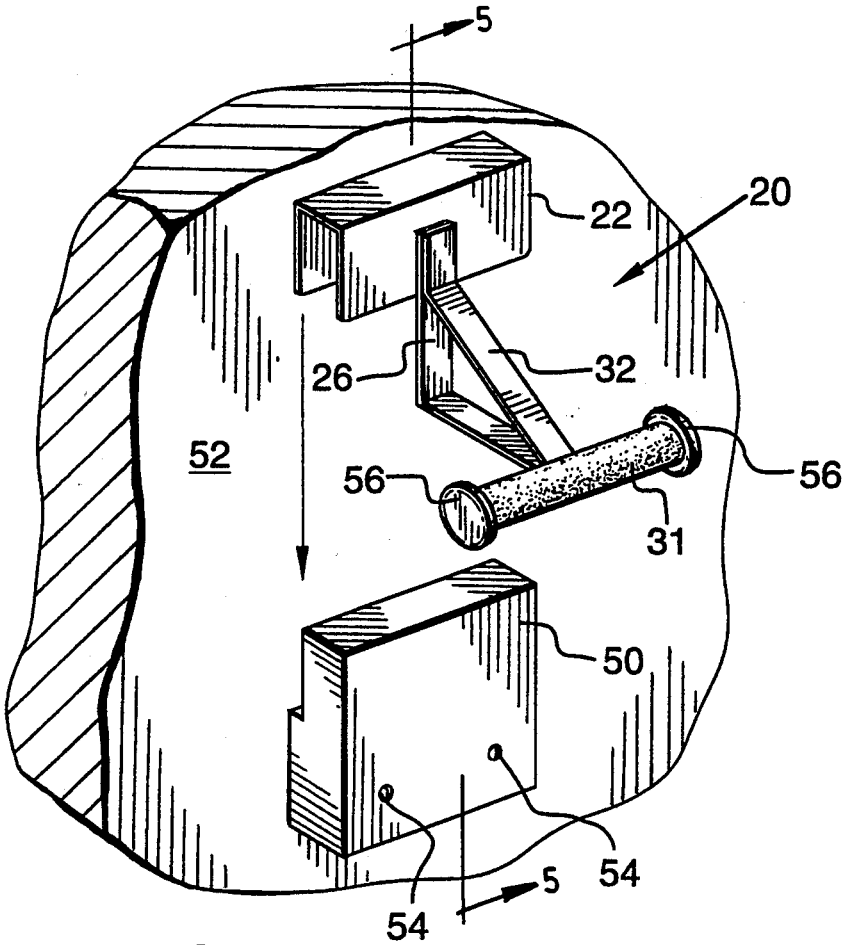
FIG. 4 is a perspective view of a second usage of the first embodiment of the bow hanger of the subject invention, the hanger shown fitted around the top of a block fastened to a vertical surface.
Figure 5:
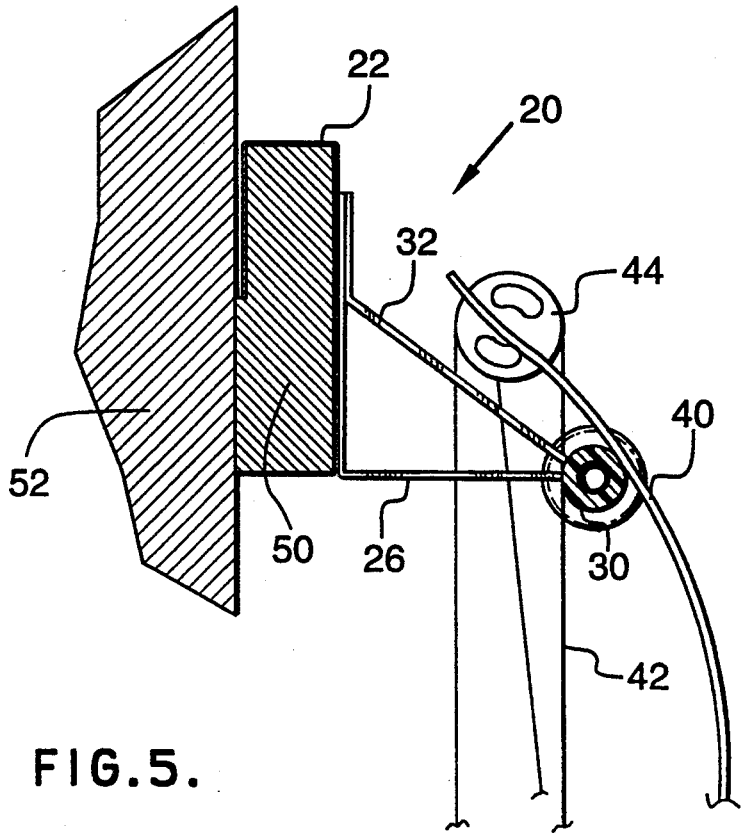
FIG. 5 is a partially-sectioned side view of the bow hanger of FIG. 4, the hanger being shown fitted around the top of the block and supporting a compound bow.

FIGS. 4 and 5 illustrate a second usage of the bow hanger of the first embodiment. In this usage the hanger 20 is adapted to fit over a block 50 secured to a vertical surface 52 by a pair of fasteners 54. The top portion of block 50 has a thickness approximating that of the door 24 in FIG. 3; that thickness is less than that of the lower portion of block 50 by an amount sufficient to accept the hook member 22. The surface 52 could be either a door or a wall or any other vertical surface capable of receiving the fasteners 54. FIG. 4 also illustrates a plastic end cap 56 fitted to each end of pipe section 30 to prevent a bow or bows on the pipe section from sliding off.

Figure 9:
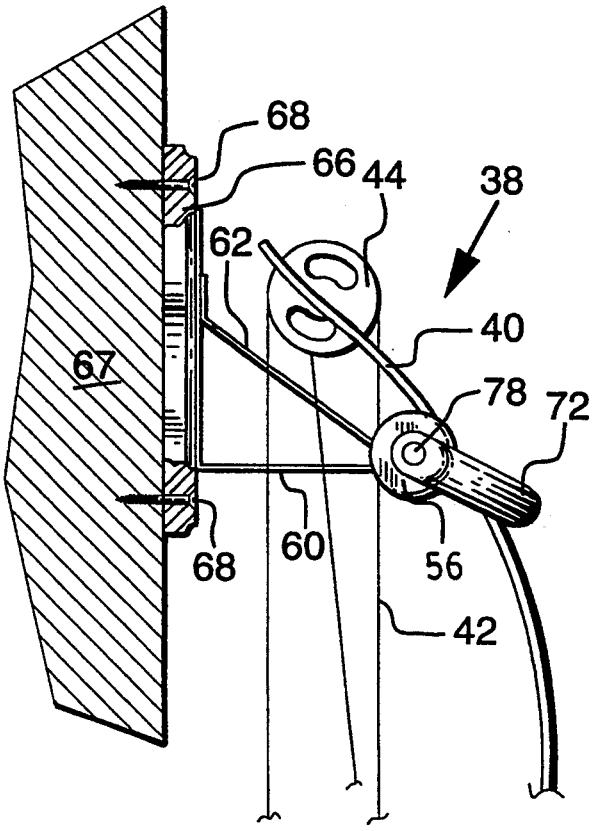
FIG. 9 is a partially-sectioned side view of the bow hanger of FIG. 6, the view also illustrating a compound bow supported on the bow hanger.

FIGS. 6 to 9 illustrate a second embodiment of the bow hanger. In this embodiment a first bracket piece 60 and a second bracket piece 62 are secured by a pair of fasteners 64 to a plate 66 which itself is adapted to be secured to vertical surface 67 by a pair of fasteners 68. The plate 66 may be a wooden plaque (possibly oak or walnut), and that plaque may have a picture mounted on it to conceal the fasteners 68. Bracket pieces 60 and 62 are both welded to a central position on a pipe section 70, which is covered by a foam cushion 71. U-shaped member 72 has an aperture 74 in each end. Each of the apertures 74 has a diameter approximating the diameter of the hole 76 in pipe section 70. A bolt 78 having a head 80 on its first end is adapted to be fitted through the apertures 74 and 76 when each end of U-shaped member 72 abuts a respective end of pipe section 70. With bolt 78 so fitted, a hole 80 on the other end of bolt 78 is exposed to receive a lock 82. With the lock 82 extending through hole 80, the bolt 78 cannot be withdrawn. With bolt 78 extending through pipe section 70 and U-shaped member 72, as shown in FIG. 9, placement of lock 82 on the end of bolt 78 prevents an archery bow 38 held on pipe section 70 from being removed.

What is claimed as the invention is:

1. A hanger for archery bows, comprising:

(a) an attachment portion adapted to be fitted to a vertical surface of a building structure at a sufficient height that when one end of an archery bow is supported on the hanger the other end of the bow is positioned above the floor;

(b) an extension portion secured to the attachment portion so as to extend away from the vertical surface of the building when the attachment portion is fitted to that surface;

(c) a bow support bar secured to the extension portion so as to extend in generally parallel spaced relation with the vertical surface of the building structure when the attachment portion is fitted to that surface, whereby, with the hanger fitted to the vertical surface of the building, a bow may be supported on the bow support bar of the hanger such that the bar extends between the limb and the string on the one end of the bow, the limb of the bow being oriented to face away from the vertical surface; and (d) locking means securable to opposite ends of said bow support bar to form a closed loop with said bow support bar, said closed loop passing around said bow to prevent removal of said bow.

2. A hanger for archery bows as in claim 1, wherein the attachment portion is a generally U-shaped bracket having a pair of parallel side members and a cross member integrally connected to the side members, the side members and cross member having a configuration and a thickness sufficiently thin to allow the bracket to be fitted around the top part of a closed door.

3. A hanger for archery bows as in claim 1, wherein the attachment portion comprises a block adapted to be secured by fasteners to the vertical surface of the building, and wherein the attachment portion also comprises a generally U-shaped bracket having a pair of parallel side members and a cross member integrally connected to the side members, the side members and cross member having a configuration allowing the bracket to be fitted around the top part of the block.

4. A hanger for archery bows as in claim 1, wherein the attachment portion comprises a plate adapted to be fastened to the vertical surface of the building.

5. A hanger for archery bows as in claim 1, wherein said locking means comprises a bolt adapted to extend through the support bar, and a U-shaped member having an aperture on each of its ends and a separation between those ends at least equal to the length of the support bar, the bolt being adapted to extend through the support bar and through the apertures on the ends of the U-shaped member when each of those ends is abutting a respective end of the support bar, and a lock adapted to fit onto the bolt to prevent withdrawal of the bolt when the U-shaped member is in the secured position.

6. A hanger for archery bows as in claim 5, wherein the attachment portion is a generally U-shaped bracket having a pair of parallel side members and a cross member integrally connected to the side members, the side members and cross member having a configuration and a thickness sufficiently thin to allow the bracket to be fitted around the top part of a closed door.

7. A hanger for archery bows as in claim 5, wherein the attachment portion comprises a block adapted to be secured by fasteners to the vertical surface of the building, and wherein the attachment portion also comprises a generally U-shaped bracket having a pair of parallel side members and a cross member integrally connected to the side members, the side members and cross member having a configuration allowing the bracket to be fitted around the top part of the block.

8. A hanger for archery bows as in claim 5, wherein the attachment portion comprises a plate adapted to be fastened to the vertical surface of the building.

* * * * *